US005946744A

United States Patent [19]

Peterson

[11] Patent Number: 5,946,744

[45] Date of Patent: Sep. 7, 1999

[54] INFLATABLE SWIMMING POOL CONSTRUCTION

[75] Inventor: Leroy L. Peterson, Omaha, Nebr.

[73] Assignee: Sportstuff, Inc., Omaha, Nebr.

[21] Appl. No.: 09/141,037

[22] Filed: Aug. 27, 1998

[51] Int. Cl.[6] ..... E04H 4/00

[52] U.S. Cl. ..... 4/506; 4/507; 4/511; 4/588

[58] Field of Search ..... 4/488, 506, 507, 4/511, 513, 584, 585, 586, 588, 589, 593; 441/40, 41

[56] References Cited

U.S. PATENT DOCUMENTS 2,718,014 9/1955 Mizrach et al. ..... 4/506
2,838,768 6/1958 Fischett ..... 4/507
3,363,268 1/1968 Friedlander ..... 4/506
4,383,564 5/1983 Hoie ..... 4/506

*Primary Examiner*—Henry J. Recla
*Assistant Examiner*—Tuan Nguyen
*Attorney, Agent, or Firm*—Henderson & Sturm

[57] ABSTRACT

An inflatable swimming pool construction that gives high resistance to deformation of the sidewall when filled with water. The pool includes a central ring with a circular cross-section, and attached top and bottom rings having a cresent-shaped cross-section. The central ring provides the majority of the overall vertical height of the pool sidewall, with the top and bottom rings providing a stable addition to the height.

14 Claims, 1 Drawing Sheet

INFLATABLE SWIMMING POOL CONSTRUCTION

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of inflatable swimming pools, and more particularly to an inflatable swimming pool made of a multi-compartment construction.

2. Description of the Related Art

Inflatable swimming pools are well known in the art and generally comprise an inflatable ring with a flooring panel sealed to the ring around its lower edge and typically fabricated from various plastics, such as polyvinylchloride (PVC). With the increasing costs of in-ground concrete swimming pools, however, larger above-ground pools with increased depth have become more popular. Inflatable pools, however, have heretofore been unsuitable with the increased depth due to the tremendous increase in water pressure on the sides of the pool which causes the walls to deform and tear. This has lead to above-ground pools with wooden or metal superstructures generally supporting a plastic liner which is more expensive and more difficult to assemble, disassemble and store.

Those concerned with these and other problems recognize the need for an improved inflatable swimming pool.

BRIEF SUMMARY OF THE INVENTION

The present invention provides an inflatable swimming pool construction that gives high resistance to deformation of the sidewall when filled with water. The pool includes a central ring with a circular cross-section, and attached top and bottom rings having a cresent-shaped cross-section. The central ring provides the majority of the overall vertical height of the pool sidewall, with the top and bottom rings providing a stable addition to the height.

Therefore, an object of the present invention is the provision of an improved inflatable swimming pool.

Other objects, advantages, and novel features of the present invention will become apparent from the following detailed description of the invention when considered in conjunction with the accompanying drawings.

DETAILED DESCRIPTION OF THE INVENTION

Figure 1:
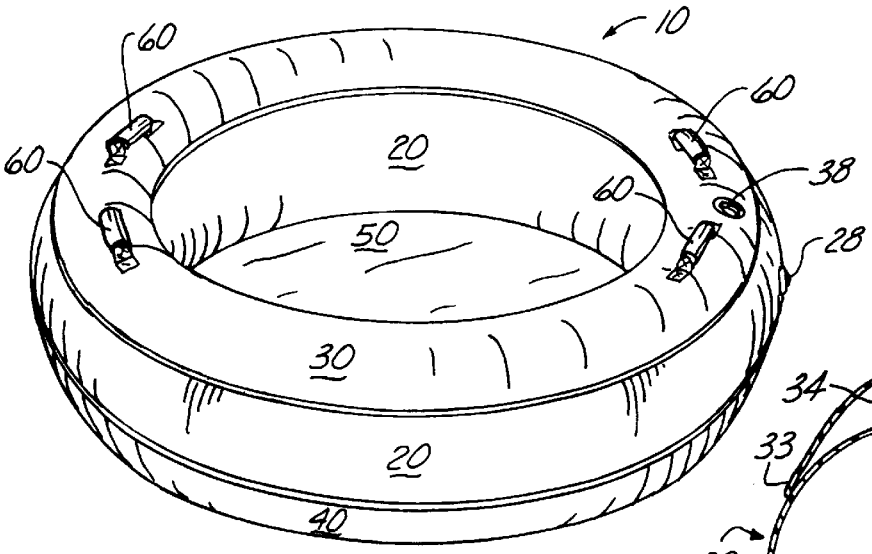
FIG. 1 is a perspective view of the inflatable swimming pool of the present invention.
Figure 3:
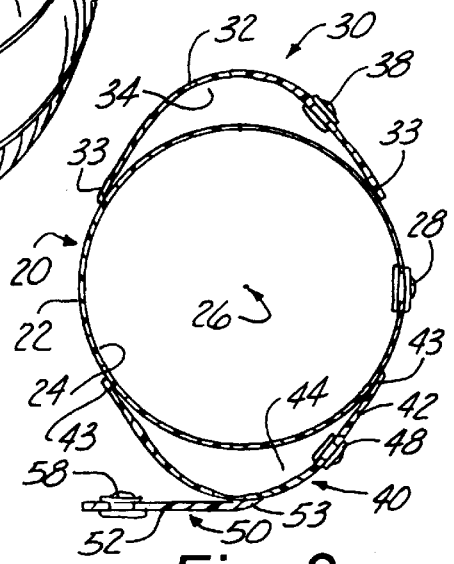
FIG. 3 is a sectional view taken along line 3—3 of FIG. 2.
Figure 2:
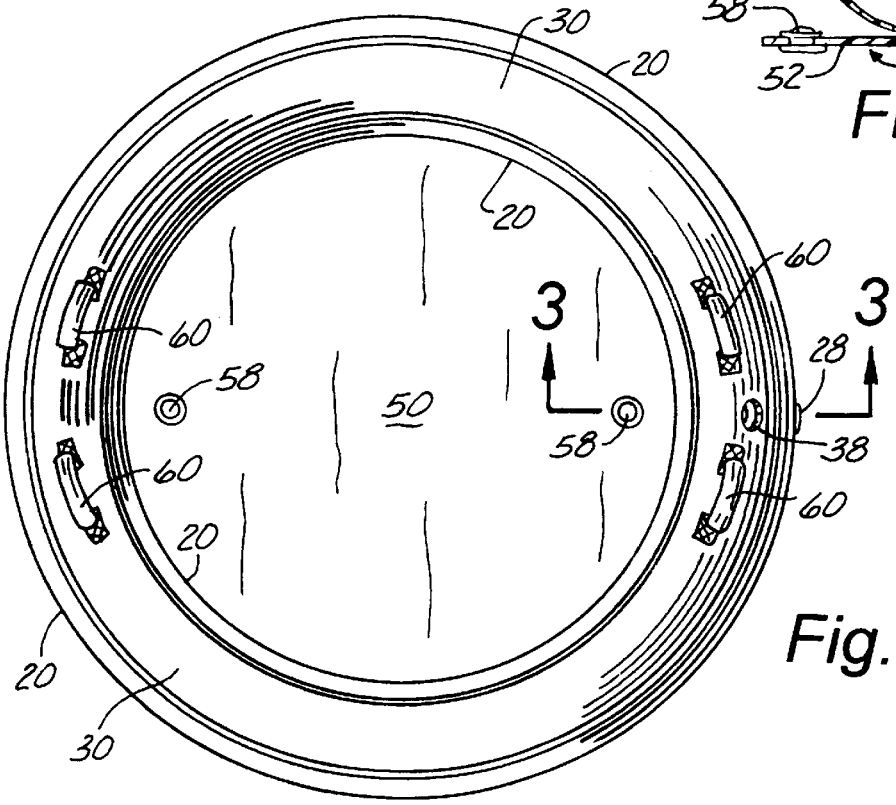
FIG. 2 is a top plan view thereof.

Referring now to the drawings, wherein like reference numerals designate identical or corresponding parts throughout the several views, FIGS. 1–3 show the inflatable swimming pool 10 of the present invention. The pool 10 includes an inflatable central ring 20, an inflatable top ring 30, an inflatable bottom ring 40, and a floor panel 50.

The central ring 20 has a peripheral wall 22 that defines a central air chamber 24. The air chamber 24 is of a circular cross-section with a center 26 and a predetermined diameter dependent on the desired overall size of the pool 10. An inflation valve 28 on the outer surface of the central ring 20 is disposed in fluid communication with the central air chamber 24 and allows for inflation of the chamber 24 when the pool 10 is in use, and deflation of the chamber 24 for storage.

The top ring 30 has a wall 32 that is attached by sealing at its edges 33 to a top arcuate section of the peripheral wall 22 of the central ring 20. A cresent-shaped air chamber 34 is thus formed having a downwardly directed concave portion. An inflation valve 38 is carried on the outer surface of the top ring 30 in vertical alignment with the inflation valve 28.

The bottom ring 40 includes a wall 42 sealingly attached at its edges 43 to a bottom arcuate section of the peripheral wall 22 of the central ring 20. This forms a cresent-shaped air chamber 44 with an upwardly directed concave portion. The inflation valve 48 is positioned of the outer surface of the bottom ring in vertical alignment with the other valves 28 and 38.

The floor panel 50 includes a circular sheet 52 attached by sealing of its outer edge 53 to the bottom of the bottom ring 40. A pair of drain valves 58 allow for release of water from the pool 10. Hand grips 60 are attached to the top ring 30 to assist the user in moving into or out of the pool 10, and also in transporting the emptied pool 10 from one location to another.

As best shown in FIG. 3, the central ring 20 provides approximately seventy-five percent of the overall height of the pool 10. The cresent-shaped top and bottom rings 30, 40 provide a stable addition to the overall height of the pool 10 that resists deformation when the pool 10 is filled with water.

Components of the pool 10 are formed from suitable plastic material including polyvinylchloride (PVC) secured together by thermo-welding or other available methods.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An inflatable swimming pool, comprising:

an inflatable central ring including a first inflation valve and having a peripheral wall defining a central air chamber having a circular cross-section with a center and a predetermined diameter;

an inflatable top ring, including a second inflation valve and having a wall with inner and outer peripheral edges sealingly attached, respectively, to a top arcuate section of the peripheral wall of the central ring to form a top air chamber having cresent-shaped cross-section including a downwardly directed concave portion;

an inflatable bottom ring, including a third inflation valve and having a wall with inner and outer peripheral edges sealingly attached, respectively, to a bottom arcuate section of the peripheral wall of the central ring to form a bottom air chamber having a cresent-shaped cross-section including an upwardly directed concave portion; and a floor panel sealingly attached to a bottom portion of the bottom ring and being disposed to extend across the bottom ring to form an open topped swimming pool.

2. The inflatable swimming pool of claim 1, wherein the top ring is disposed above the center of the central ring.

3. The inflatable swimming pool of claim 2, wherein the bottom ring is disposed below the center of the central ring.

4. The inflatable swimming pool of claim 1, wherein the bottom ring is disposed below the center of the central ring.

5. The inflatable swimming pool of claim 1, wherein the cross-sectional diameter of the central ring comprises about seventy-five percent of and overall height of the swimming pool.

6. The inflatable swimming pool of claim 5, wherein the top ring is disposed above the center of the central ring.

7. The inflatable swimming pool of claim 6, wherein the bottom ring is disposed below the center of the central ring.

8. The inflatable swimming pool of claim 5, wherein the bottom ring is disposed below the center of the central ring.

9. The inflatable swimming pool of claim 1, wherein the first inflation valve is disposed on an outer surface of the central ring.

10. The inflatable swimming pool of claims 9, wherein the second inflation valve is disposed on an outer surface of the top ring.

11. The inflatable swimming pool of claim 10, wherein the third inflation valve is disposed on an outer surface of the bottom ring.

12. The inflatable swimming pool of claim 11, wherein the first, second and third inflation valves are vertically aligned.

13. The inflatable swimming pool of claim 12, wherein the floor panel includes a drain valve.

14. The inflatable swimming pool of claim 13, further including a plurality of hand grips attached to the top ring.

* * * * *